US006595456B2

(12) United States Patent
Rummage

(10) Patent No.: US 6,595,456 B2
(45) Date of Patent: Jul. 22, 2003

(54) TEXTILE TUBE WITH START-UP FEATURE

(75) Inventor: Tony F. Rummage, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/955,634

(22) Filed: Sep. 19, 2001

(65) Prior Publication Data

US 2003/0052213 A1 Mar. 20, 2003

(51) Int. Cl.[7] ..... B65H 67/04; B65H 19/28

(52) U.S. Cl. ..... 242/476.6; 242/173; 242/125.1; 242/583

(58) Field of Search ..... 242/476.6, 476.5, 242/583, 587.1, 125.1, 125.2, 173, 532.3

(56) References Cited

U.S. PATENT DOCUMENTS

| | | | | |
|---|---|---|---|---|
| 2,327,738 A | | 8/1943 | Perry | |
| 2,765,129 A | | 10/1956 | Dunlap | |
| 3,801,038 A | | 4/1974 | Wust | |
| 3,876,165 A | | 4/1975 | Comer | |
| 3,967,795 A | | 7/1976 | Shindo et al. | |
| 3,986,680 A | * | 10/1976 | Cardell | 242/125.1 |
| 4,050,645 A | * | 9/1977 | Burchette, Jr. et al. | 242/125.1 |
| 4,050,646 A | * | 9/1977 | Burchette, Jr. | 242/125.1 |
| 4,057,201 A | | 11/1977 | Wilkinson | |
| 4,063,688 A | | 12/1977 | Grellier | |
| 4,063,696 A | | 12/1977 | Kelly et al. | |
| 4,184,653 A | | 1/1980 | Bonzo | |
| 4,298,122 A | | 11/1981 | Ekelund | |
| 4,369,933 A | | 1/1983 | Bedenbaugh | |
| 4,371,130 A | | 2/1983 | Case | |
| 4,842,213 A | | 6/1989 | Bärtschi et al. | |
| 4,901,941 A | | 2/1990 | Powel et al. | |
| 4,907,758 A | | 3/1990 | Powel et al. | |
| 4,919,359 A | | 4/1990 | Powel et al. | |
| 4,936,523 A | | 6/1990 | Powel et al. | |
| 5,029,762 A | | 7/1991 | Behrens et al. | |
| 5,211,354 A | | 5/1993 | Rummage | |
| 5,328,121 A | | 7/1994 | Rummage | |
| 5,495,087 A | | 2/1996 | Rummage | |
| 5,505,395 A | * | 4/1996 | Qiu et al. | 242/118.32 |
| 6,079,650 A | | 6/2000 | Scaglia | |
| 6,435,436 B1 | * | 8/2002 | Auten | 242/118.32 |

FOREIGN PATENT DOCUMENTS

| | | | | |
|---|---|---|---|---|
| JP | 5-58560 A | * | 3/1993 | 242/583 |
| JP | 5-147830 A | * | 6/1993 | 242/583 X |

* cited by examiner

*Primary Examiner*—Michael R. Mansen
(74) *Attorney, Agent, or Firm*—Alston & Bird LLP

(57) ABSTRACT

A textile tube on which yarn is wound to form a pack comprises a body having a tubular body extending between opposed ends and an outer surface. At least one recessed score is defined proximate at least one end of the tube body. The recessed score has a substantially rectangular shape wherein the width of the recessed score is at least about five time the depth of the recessed score. As such, the recessed score provides more surface area for capturing yarn during a winding procedure. The recessed score also retains a substantially constant shape regardless of the moisture content of the tube, which is particularly advantageous when the tube body is formed of paperboard or other hygroscopic material.

12 Claims, 2 Drawing Sheets

TEXTILE TUBE WITH START-UP FEATURE

FIELD OF THE INVENTION

The present invention relates generally to textile tubes or yarn cores, and more particularly relates to a textile tube having at least one start-up recess or groove for capturing textile yarn during a winding operation.

BACKGROUND OF THE INVENTION

The practice of winding yarn onto tubular carriers during textile production is well known in the art. During high speed production of yarn or thread, the continuously advancing yarn is wound onto consecutive rotating cores or tubes. As a rotating tube encounters a leading strand of the yarn, the tube frictionally engages the yarn to secure an initial wind of the yarn onto the tube and simultaneously break the yarn between the tube and the preceding tube. Therefore, it is important that the tube be able to successfully engage the leading strand of yarn to secure the yarn to the tube and to break the yarn from the preceding tube.

Conventional tubes often employ a "start-up" groove for receiving the leading strand of yarn. The groove is typically "V" shaped and formed near one or both ends of the tube by forcing a wedged-shaped tool into the side of the tube. The groove has a "wide" section about a portion of the circumference of the tube so that the yarn can locate within the groove, and a "narrow" section for catching and breaking the yarn. Such a groove is disclosed in U.S. Pat. No. 5,328,121, which is assigned to the assignee of the present invention and incorporated herein by reference in its entirety. While the start-up grooves disclosed by the '121 patent have become an industry standard in the textile winding field, there are still improvements to be made.

It has been discovered that there are occasions where the yarn misses the wide target area of the groove and results in a failed start up, which causes production problems such as downtime and wasted material. There are several reasons why failed start ups occur, among them being (a) variation in yarn tension, (b) improper location of mechanical yarn guides, and (c) variation in groove dimensions. In particular, it has been discovered that the moisture content of the tube can have significant effects on the grooves, as most tubes are formed of paperboard and therefore are somewhat hygroscopic, i.e., capable of gaining and losing moisture. More specifically, a relatively high moisture content of the tube can cause the paperboard to swell, which effectively closes the V-shaped groove and makes successful start ups less likely. Because most textile winding operations are performed in large manufacturing facilities, controlling and maintaining the moisture content and temperature in the surrounding atmosphere is difficult. Thus, there is a need for a tube or core for winding yarn that is less reactive to humidity and other environmental conditions. There is also a need for a yarn tube that allows for easier yarn start-ups.

SUMMARY OF THE INVENTION

These and other needs are provided by the textile tube of the present invention, which provides a recessed score around the outer circumference of the body of the tube that provides a significantly wider target for the yarn to engage. As such, successful start-ups are more likely to occur with the tube of the present invention. In addition, the shape of the score of the present invention remains substantially constant regardless of the tube's moisture content, which thereby overcomes the hygroscopic disadvantages of conventional grooves.

In particular, the textile tube of the present invention is used to support yarn that is wound thereon to form a yarn pack. According to one embodiment of the present invention, the tube comprises a tubular or cylindrical body extending lengthwise between opposed ends thereof and having an outer surface defining an outer diameter of the body. The body defines at least one recessed score at an end thereof that has a flat bottom surface and opposing sidewalls to define a width and depth of the score. The bottom surface extends in a plane that is parallel to the outer surface of the body, and in a preferred embodiment the opposing sidewalls are parallel to one another and perpendicular to the bottom surface of the score. The bottom surface of the recessed score is at least five times the depth and is capable of frictionally engaging or capturing yarn that comes in contact therewith. In one embodiment, the score has a width of between about 0.15–0.20 inches and a depth of 0.01–0.03 inches.

In addition, the bottom surface of the recessed score has an adhesive applied thereto, such as a hot melt adhesive or a double-sided tape. In this regard, the adhesive captures the yarn as the yarn is wound upon the tube. The score is formed such that the adhesive preferably does not extend past the outer surface of the tubular body, which could otherwise cause the tube to stick to an unwanted object that comes in contact therewith.

Advantageously, the recessed score of the present invention substantially retains its shape regardless of the moisture content of the tube. More specifically, the bottom surface and opposing sidewalls form a substantially rectangular cross-section that is more resistant to dimensional changes compared to rounded or V-shaped grooves. And the recessed score of the present invention provides a substantially greater surface area to capture the yarn compared to conventional grooves regardless of the moisture content of the tube.

BRIEF DESCRIPTION OF THE DRAWINGS

Figure 1:
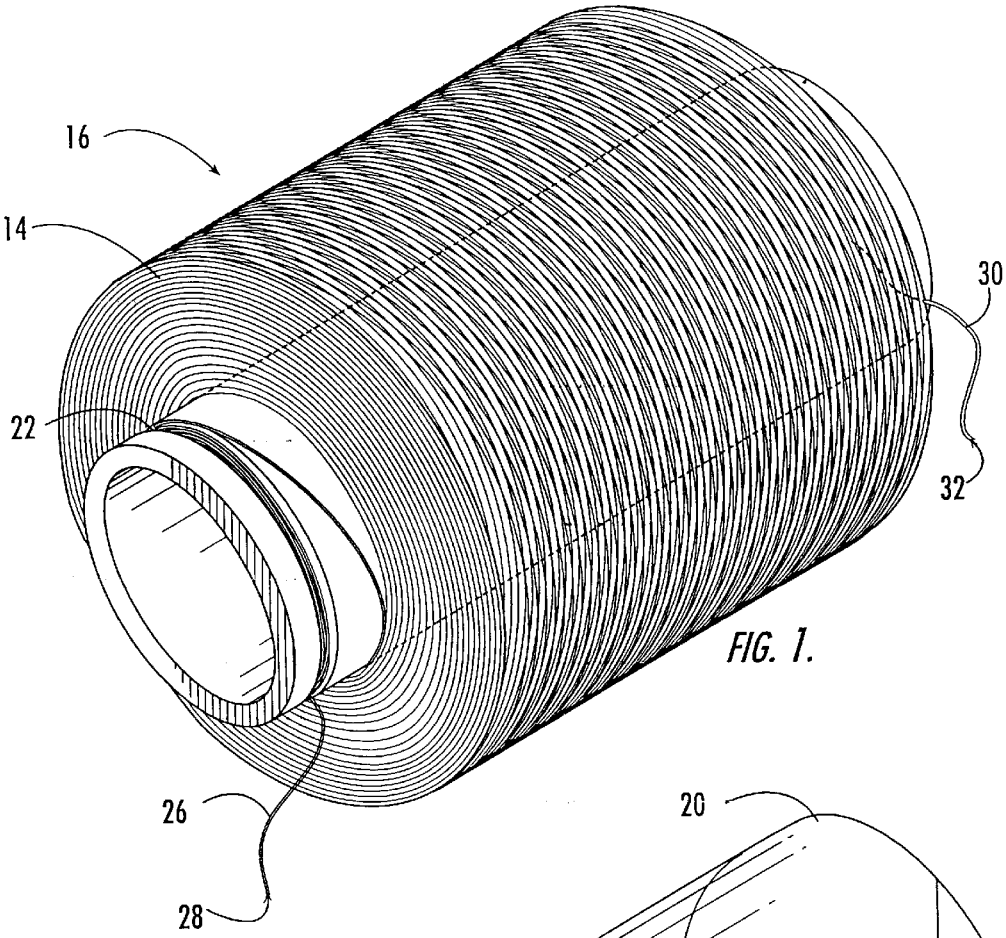
Figure 2:
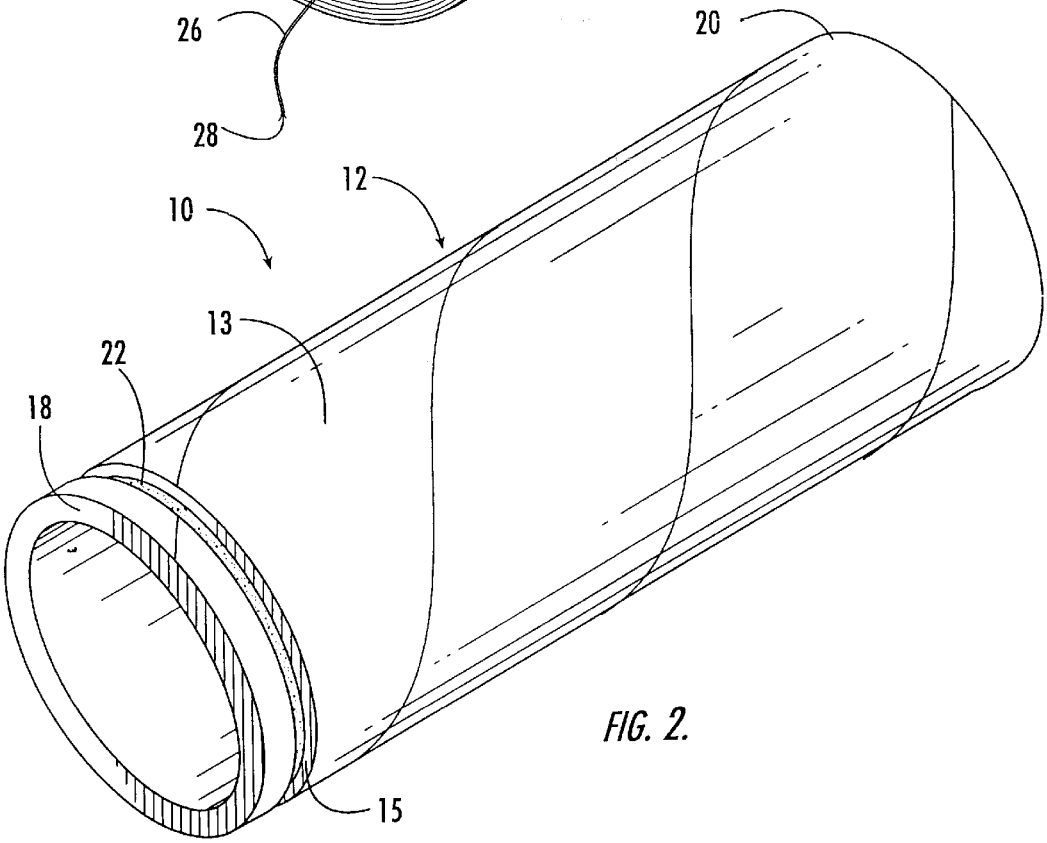
Figure 3:
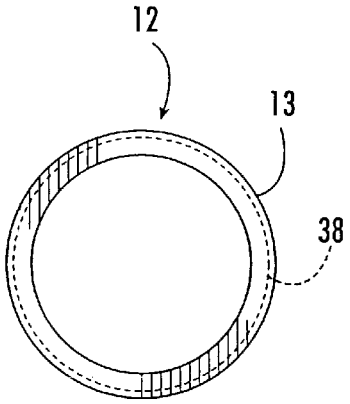
Figure 4:
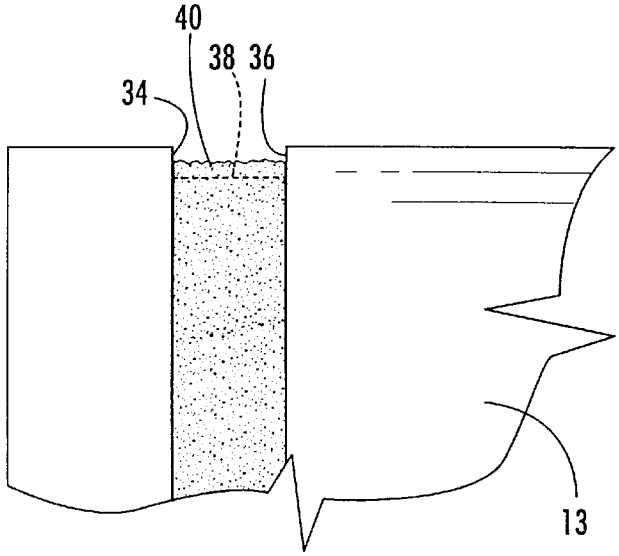
Figure 5:
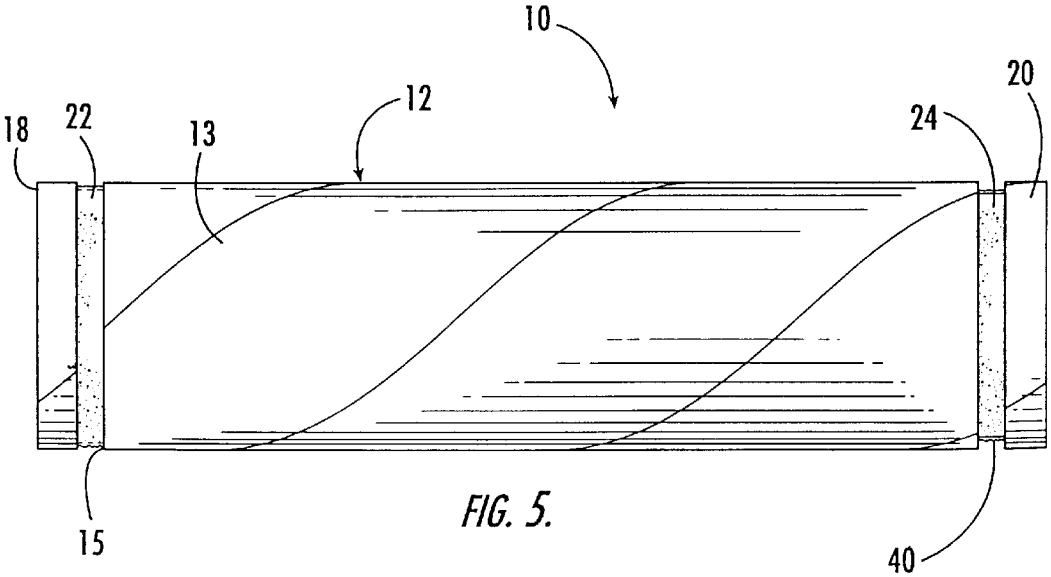

Having thus described the invention in general terms, reference will now be made to the accompanying drawings, which are not necessarily drawn to scale, and wherein:

FIG. 1 is a perspective side view of a winding tube having a pack of yarn wound thereon according to one embodiment of the present invention;

FIG. 2 is a perspective side view of a winding tube according to one embodiment of the present invention;

FIG. 3 is an end view of a winding tube according to one embodiment of the present invention;

FIG. 4 is a detailed side view of a portion of a winding tube according to one embodiment of the present invention; and FIG. 5 is a side view of a winding tube according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 and 2 show perspective views of a textile carrier or tube 10 for supporting a continuous strand of yarn 14 wound about the tube into a pack 16. The tube 10 is suitable for high speed yarn winding operations, such as during the manufacture of textiles. During a typical winding operation, the yarn 14 is wound about a plurality of consecutively aligned tubes and transferred from one tube to the next by a yarn guide (not shown) according to known techniques. In particular, the yarn 14 includes a lead portion 26 that contacts the tube initially according to conventional practice. The yarn 14 also includes a tail portion 30, as discussed more fully below.

The tube 10 includes a tubular, elongate body 12 that is formed of a durable material, such as paperboard, plastic, metal, carbon fiber, and the like. The tube 10 of the present invention is particularly advantageous when paperboard tubes are used in the winding operation, as paperboard tubes are relatively inexpensive to manufacture and the advantages of the present invention are more clearly shown. The body 12 preferably is suitable for repeated use through many winding operations, and includes opposing ends 18, 20 and an outer surface 13 extending therebetween. The body 12 also includes an inner surface 15 extending between the opposing ends 18, 20. During a winding operation the yarn 14 is wound into the pack 16 about the outer surface 13 of the body 12 of the tube 10, as discussed below.

The body 12 also has a recessed score 22 proximate one of the ends 18, 20. In one embodiment, the score 22 is located about 0.30–0.40 inches from the end of the tube and has a flat bottom surface 38 and a pair of opposing sidewalls 34, 36. In particular, the bottom surface 38 defines the width of the score 22 and extends in a plane substantially parallel to that of the outer surface 13 of the body 12. The opposing sidewalls 34, 36 are spaced apart by the bottom surface 38 and extend from the bottom surface to the outer surface 13 of the body 12 to define the depth of the score 22. In one embodiment, the opposing sidewalls 34, 36 are substantially perpendicular to the bottom surface 38. Preferably, the opposing sidewalls 34, 36 are parallel to one another as well as being perpendicular to the bottom surface 38 so that the recessed score 22 has a substantially rectangular shape. While the exact dimensions of the score 22 depend on several factors, such as the size of the yarn 14, the size of the tube body 12, and the like, the width of the recessed score as defined by the bottom surface 38 is about five times the depth of the score. For example, the tube can have a length of about 150–350 mm, an inner diameter of about 75–143 mm, and a wall thickness of about 5–9mm. The recessed score 22 can have a width of about 0.15–0.20 inches and a depth of about 0.01–0.03 inches. These dimensions are provided for illustration purposes only, however, as the dimensions can be greater or less than the ranges described herein.

FIG. 3 shows an end view of the tube body 12. As shown, the bottom surface 38 is recessed from the outer surface 13 of the tube body 12. However, the depth of the recessed score 22 is only a fraction of the wall thickness of the tube body 12 that is defined as the distance between the outer surface 13 and the inner surface 15 of the tube body.

The recessed score 22 is shaped so as to be resistant to relative dimensional changes if the tube body 12 changes shape. This can occur when the tube body 12 is formed of paperboard or other material that are hygroscopic. While conventional V-shaped grooves tend to "shrink " or close as the paperboard material forming the tube swells with an increase in moisture level, which thereby greatly reduces or eliminates the ability of the groove to capture the yarn, the recessed score 22 of the present invention retains its substantially rectangular shape regardless of the moisture content of the tube body 12. Specifically, the generally perpendicular configuration defined by the bottom surface 38 and the sidewalls 34, 36 is relatively constant regardless of any changes to the shape of the tube body 12. Thus, while it is possible that the width and/or depth of the score 22 may vary depending on the moisture content of the tube body 12, the score 22 retains a substantially constant rectangular shape. As such, the score 22 of the present invention does not close or shrink as in conventional tube grooves such that the yarn 14 is prevented from being captured. Thus, the recessed score 22 of the present invention captures yarn 14 better than conventional tube grooves in a wider range of conditions.

FIG. 4 shows a detailed side view of a portion of the tube 10 according to one embodiment. Advantageously, the bottom surface 38 of the recessed score 22 is designed to capture the yarn 14 during the winding operation. In this regard, at least a portion of the bottom surface 38 according to one embodiment has an adhesive 40 applied thereto. The adhesive 40 can be formed from many materials. For example, a hot melt adhesive, such as hot melt pressure sensitive adhesives designed for labeling applications and sold under the names HM-2703, HL2198X, and HL2203X by H. B. Fuller Company of St. Paul, Minn., can be used. Alternatively, the adhesive 40 can be a double-sided tape, such as double-sided tapes sold under the model numbers 465, 463, 926, 928, 976, and 970 by 3M Company of St. Paul, Minn., can be used. The adhesive 40 can also be applied to at least a portion of the sidewalls 34, 36, and the adhesive 40 can be applied in a uniform, patterned, or random fashion about the surfaces of the recessed score 22. Advantageously, the adhesive 40 is positioned below the outer surface 13 of the tube body 12. As such, the tube 10 can be placed adjacent other tubes, such as when stacking or storing a plurality of tubes, or handled by an operator without inadvertently sticking or transferring adhesive to another surface.

The adhesive 40 enables the yarn 14 to be captured in the recessed score 22. At least one wrap, and preferably about 3–50 wraps, are captured or releasably secured in the score 22 at the beginning of a winding operation for the tube 10. The winding operation includes transferring a continuous strand of yarn 14 from one tube to another by a yarn guide (not shown). In particular, the continuous strand of yarn 14 is fed from a continuous yarn spinning process and captured in the recessed score 22 of the tube 10. The yarn 14 is broken at the lead portion 26 to form a lead end 28 while the tube 10 continues to rotate and receive yarn. When the tube 10 has received a predetermined amount of yarn 14, the tail portion 30 of the yarn is transferred to an adjacent "downstream" rotating tube where it is captured by a recessed score defined therein. The tube 10 stops after the yarn has been caught and broken by the downstream tube. Thus, the tail portion 30 associated with the tube 10 is broken to form the tail end 32. The process is then repeated to transfer yarn onto subsequent tubes to form as many yarn packs as desired.

FIG. 5 shows an alternative embodiment, wherein another recessed score 24 is located proximate the end 20 in addition to the recessed score 22 proximate the end 18 discussed above. Advantageously, having both recessed scores 22, 24 allows the tube to be reversible so that either end 18, 20 can be used to capture yarn 14 during the winding operation.

Therefore, the tube 10 according to the present invention provides important advancements in the art by providing at least one recessed score 22 for capturing yarn 14 during a winding operation that retains a substantially constant shape regardless of the moisture content of the tube. Thus, for hygroscopic materials, such as paperboard, the recessed score 22 according to the present invention provides a more robust start-up region for a wider variety of environmental conditions.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A textile tube on which yarn is wound to form a package, comprising:

a tubular body extending lengthwise between opposed ends thereof and having an outer surface;

a recessed score defined by the tubular body at at least one end having a substantially planar bottom surface and opposing sidewalls to define a width and depth, the bottom surface extending in a plane that is substantially parallel to the outer surface of the body so that the width of the recessed score is at least about five times the depth thereof; and an adhesive disposed in the recessed score for capturing the yarn.

2. A tube according to claim 1, wherein the adhesive is applied to at least the bottom surface of the recessed score.

3. A tube according to claim 1, wherein the adhesive is a hot melt adhesive.

4. A tube according to claim 1, wherein the adhesive is a double-sided tape.

5. A tube according to claim 1, wherein the opposing sidewalls are parallel to each other and perpendicular to the bottom surface of the recessed score.

6. A tube according to claim 1, wherein the tube includes a recessed score at each of the opposed ends thereof.

7. A tube according to claim 6, wherein at least one of the recessed scores has a width of between about 0.15–0.20 inches and a depth of about 0.01–0.03 inches.

8. A tube according to claim 6, wherein the opposing sidewalls of each recessed score are parallel to each other and perpendicular to the bottom surface thereof.

9. A tube according to claim 6, wherein the recessed scores retain a substantially constant shape regardless of the tube's moisture content.

10. A tube according to claim 1, wherein the recessed score has a width of between about 0.15–0.20 inches and a depth of about 0.01–0.03 inches.

11. A tube according to claim 1, wherein the recessed score retains a substantially constant shape regardless of the tube's moisture content.

12. A tube according to claim 1, wherein the tubular body is formed of a hygroscopic material, and wherein the recessed score retains a substantially constant shape regardless of the tube's moisture content.

* * * * *